US006131324A

United States Patent [19]

Jewell

[11] Patent Number: 6,131,324

[45] Date of Patent: Oct. 17, 2000

[54] ADJUSTABLE DUAL STAGE TRIGGER ASSEMBLY

[76] Inventor: Arnold W. Jewell, 1490 Whitewater Rd., New Braunfels, Tex. 78132

[21] Appl. No.: 09/201,006

[22] Filed: Nov. 30, 1998

[51] Int. Cl.[7] ..... F41A 19/16

[52] U.S. Cl. ..... 42/69.03; 89/139; 89/148

[58] Field of Search ..... 42/69.03, 70.08; 89/139, 148

[56] References Cited

U.S. PATENT DOCUMENTS

| | | | |
|---|---|---|---|
| 859,974 | 7/1907 | von Pocci | 89/144 |
| 2,474,456 | 6/1949 | Barnett | 42/69.03 |
| 2,855,716 | 10/1958 | Campbell | 42/69.03 |
| 2,881,547 | 4/1959 | Butler | 42/69.03 |
| 3,167,877 | 2/1965 | Jungeling | 42/69.03 |
| 3,683,537 | 8/1972 | Silva | 42/69.03 |
| 4,017,996 | 4/1977 | Liedke | 42/69.03 |
| 4,056,038 | 11/1977 | Rath | 89/128 |
| 4,151,670 | 5/1979 | Rath | 42/70.06 |
| 5,012,604 | 5/1991 | Rogers | 42/69.03 |
| 5,086,579 | 2/1992 | Flatley et al. | 42/70.08 |
| 5,501,134 | 3/1996 | Milazzo et al. | 89/139 |
| 5,697,178 | 12/1997 | Haskell | 42/70.04 |
| 5,709,046 | 1/1998 | Canaday | 42/69.01 |
| 5,718,074 | 2/1998 | Keeney | 42/69.03 |
| 5,881,485 | 3/1999 | Milazzo | 42/70.08 |

FOREIGN PATENT DOCUMENTS

| | | | |
|---|---|---|---|
| 119806 | 4/1945 | Australia | 89/148 |
| 1129165 | 1/1957 | France | 42/69.03 |
| 2110502 | 9/1972 | Germany | 42/69.03 |

*Primary Examiner*—Michael J. Carone
*Assistant Examiner*—Darren W. Ark
*Attorney, Agent, or Firm*—Joseph F. Long

[57] ABSTRACT

A dual stage trigger assembly including a spring loaded hammer, a spring loaded trigger, a disconnect lever, a torsion spring adjustment plate, springs, and user available adjustment screws whereby a sear face of the trigger fully engages a notch in the hammer in cocked position; whereby a user available adjustment screw, without disturbing the assembly, allows a user to adjust a screw in a first end of the disconnect lever to adjust second stage trigger travel to set the length of engagement of the trigger sear with the hammer notch. At this point a contact face of the disconnect lever contacts a tang on the hammer and a user available adjustment screw in a second end of the disconnect lever compressing a spring held in the trigger adjusts trigger pressure needed to complete the second stage trigger pull after the contact face on the disconnect lever contacts the hammer tang. A spring operably connected with the trigger and the torsion spring adjustment plate adjustable by the user allows a user to adjust first stage pressure on the trigger necessary to move the disconnect lever contact face against the hammer tang.

4 Claims, 3 Drawing Sheets

ADJUSTABLE DUAL STAGE TRIGGER ASSEMBLY

BACKGROUND OF THE INVENTION

The invention is particularly suited for use in AR 15 type semi-automatic firearms but with minor physical modifications could be more widely usable. The closest prior art is U.S. Pat. No. 5,501,134 issued Mar. 26, 1996 to Milazzo et al. specifically for AR 15 or M 16 type firearms. The invention is similar to Milazzo in that both use essentially a two stage trigger pull. In both the second stage of the trigger pull is adjusted to have minimal engagement between the engagement means of the hammer and trigger thereby allowing very limited second stage pull on the trigger to fire the gun. However the invention does have important differences from Milazzo. The difference are of major importance to match shooters. In Milazzo and prior art the first stage pull pressure of the trigger can only be adjusted by replacing or bending the trigger spring furnishing the pressure. The user must essentially dismantle the trigger mechanism to make this change. This is quite different than the user adjustable trigger spring loading of the subject invention wherein the trigger spring adjustment may be made without disturbing the overall assembly.

In Milazzo a disconnector pivotally connected with the trigger at one end and spring loaded on the other with a single screw compressing a spring is used to adjust the length of the contact face to achieve minimal engagement of the engagement means engaging the hammer with the trigger at the point trigger movement moves a contact face on the disconnector against a hammer tang on the hammer. Necessarily in Milazzo as the single adjustment screw is tightened to achieve minimal engagement of the hammer with the trigger the spring is being compressed and the pressure of the contact face against the hammer tang is increased thereby requiring a greater pull pressure on the second stage trigger pull to fire the gun. Any one spring can be chosen to give one set pull pressure and, of course different springs could be used to achieve different pull pressures. However changing the springs would require essentially dismantling the trigger assembly. This is in contrast with the subject invention wherein a disconnect lever pivoted in the center on a pivot pin and operably connected with the trigger uses one user adjustable screw on one end to set the minimum engagement of the engagement means engaging the trigger and the hammer before the user reaches the second stage pull and a second screw on the opposite end of the disconnector lever adjusts pressure on a spring and is in a position so that the user may easily tighten or loosen the screw to adjust pressure of the contact face of the disconnector against the hammer tang thereby adjusting pressure needed on the second stage pull to fire the gun. With the feature of the invention as outlined a match shooter may readily adjust both second stage travel and second stage pull pressure and may also easily adjust first stage pull pressure while still maintaining the desirable full engagement of the faces of the hammer and trigger engagement means with the firearm or gun in the cocked position.

Other features of the invention are known in the art.

SUMMARY OF THE INVENTION

The invention comprises a dual stage trigger assembly comprising a spring loaded hammer, a spring loaded trigger, a disconnect lever, a trigger torsion spring adjustment plate, a spring to adjust second stage pull pressure, and user available adjustment screws operably installed with a sear face of the trigger fully engaged in a notch in the hammer in a cocked position. A user available adjustment screw, without disturbing the assembly, allows a user to adjust a screw in a first end of the disconnect lever to adjust second stage trigger travel to set the length of engagement of the trigger sear with the hammer notch. At this point a contact face of the disconnect lever contacts a tang on the hammer and a user available adjustment screw in a second end of the disconnect lever compressing a spring held in the trigger adjusts trigger pressure needed to complete the second stage trigger pull after the contact face on the disconnect lever contacts the hammer tang. Completion of the second stage pull causes the gun to fire and bolt recoil resets the hammer and recocks the gun.

A spring operably connected with the trigger and the torsion spring adjustment plate and adjustable by the user forms the spring loaded trigger assembly. This assembly allows a user to adjust first stage pressure on the trigger necessary to move the disconnect lever contact face against the hammer tang which is the end of the first stage pull.

BRIEF DESCRIPTION OF THE DRAWINGS

FIG. 1 shows the basic parts of the trigger assembly as installed with the assembly in the cocked position and the safety on.

DESCRIPTION OF THE INVENTION

Figure 1:
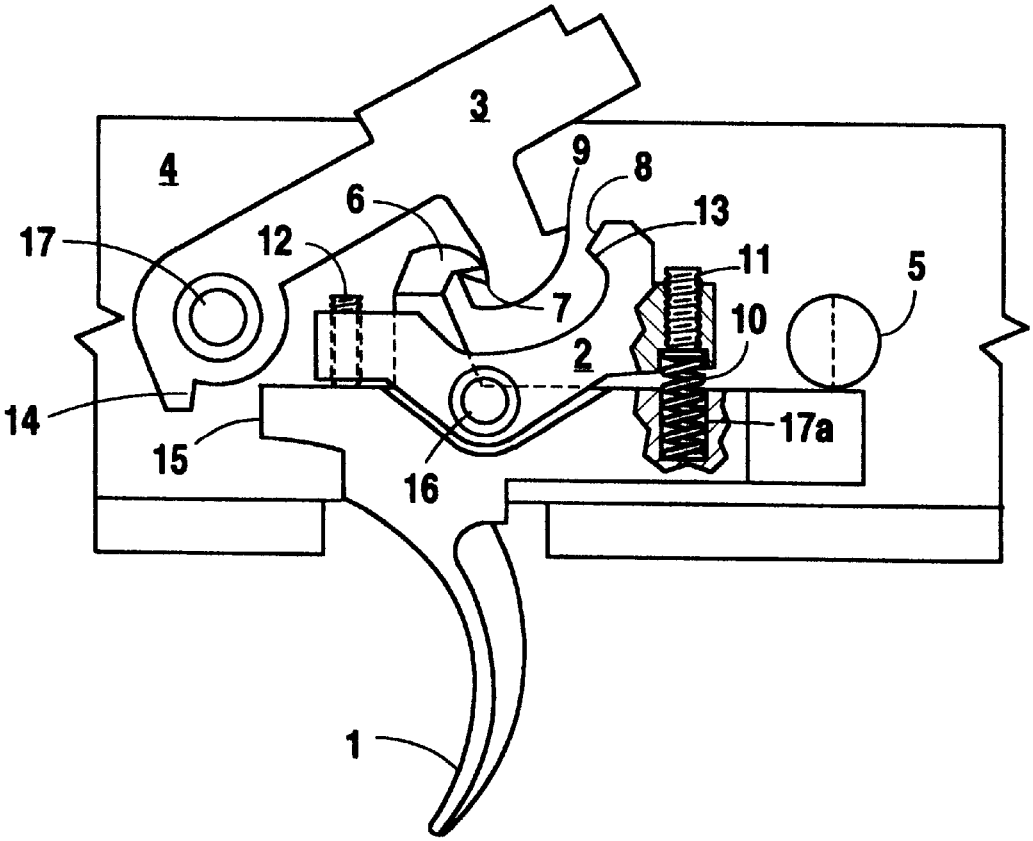

The invention may best be described from the drawings. In FIG. 1 the major elements of the trigger assembly comprising trigger 1, a disconnect lever 2, and a hammer 3 are shown in a cocked position. The hammer 3 and trigger 1 with its disconnect lever 2 are held in position in the firearm receiver cavity 4 by cross pins 16 and 17. A selected safety cam 5 shown in the "safety on" position is also incorporated in the receiver housing 4 and may be rotated counter clockwise from the fire to safe position and is spring loaded to either selected position. The hammer spring is omitted for clarity. In the cocked position shown the trigger sear 6 is fully engaged in hammer notch 7. The trigger 1 and disconnect lever 2 are both pivotally installed on pin 16 and disconnect lever 2 is operably connected with trigger 1 by fitting in a recessed portion of trigger 1. Complete pull of trigger 1 causes the trigger 1 and the disconnect lever 2 to rotate about pivot pin 16 and pull the trigger sear 6 off the hammer notch 7. The trigger sear 6 and the hammer notch 7 form the trigger and hammer engagement means. With screw 12 properly adjusted as the trigger 1 is being pulled and prior to total disengagement the contact face 8 of disconnect lever catch 13 contacts hammer tang 9. Screw 12 is user adjustable without disturbing the assembly. Screw 11, also user adjustable without disturbing the assembly, adjusts trigger pull pressure needed to move the trigger to total disengagement after face 8 contacts tang 9. As shown safety cam 5 is contacting the narrowed end of trigger 1 and must be rotated by the user to the fire position before the trigger 1 can be pulled. Cam 14 is integral to the hammer 3 and in the fired position prevents reset of the trigger by blocking the trigger from rotating at the forward end 15. This arrangement prevents the safety from being applied in the fired position to prevent damage to the trigger sear 6 or to the hammer notch 7 if the action were manually recocked with the safety in the safe position.

Figure 2:
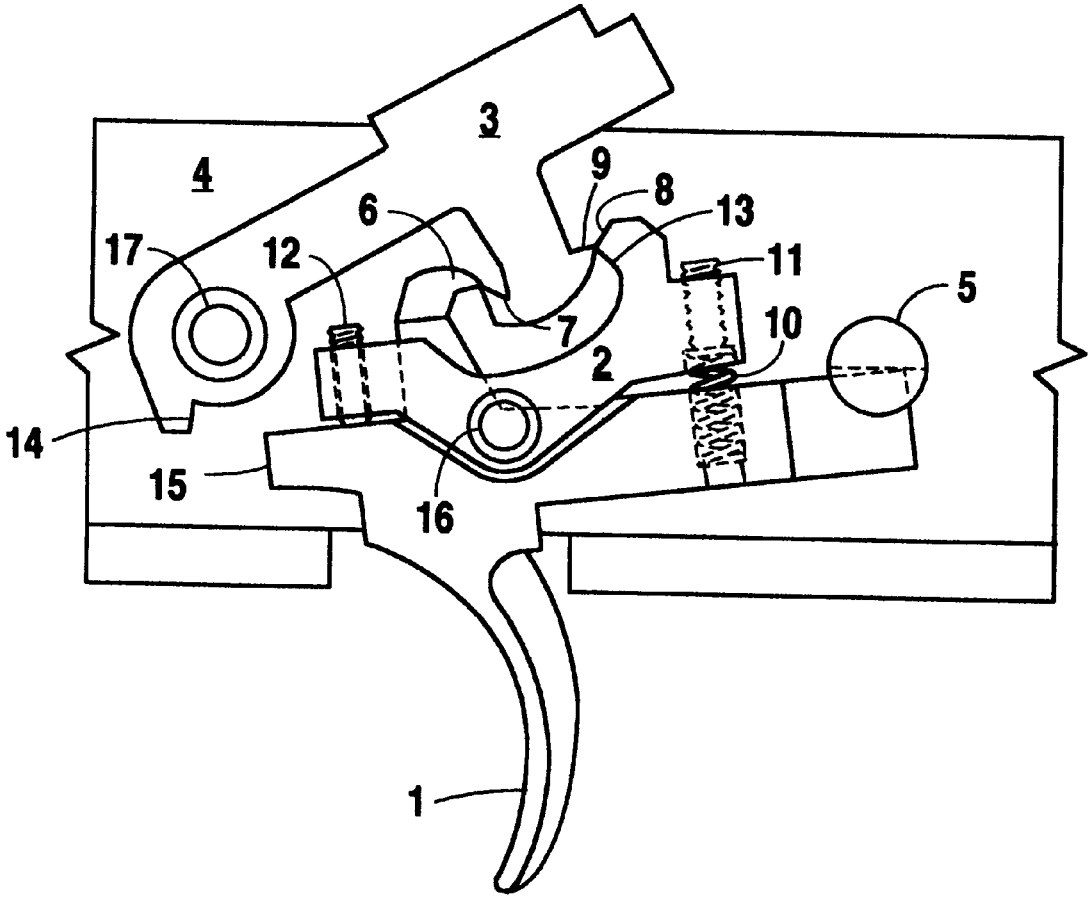
FIG. 2 shows the trigger assembly with the safety in the off position at the end of the first stage of the trigger pull.
Figure 3:
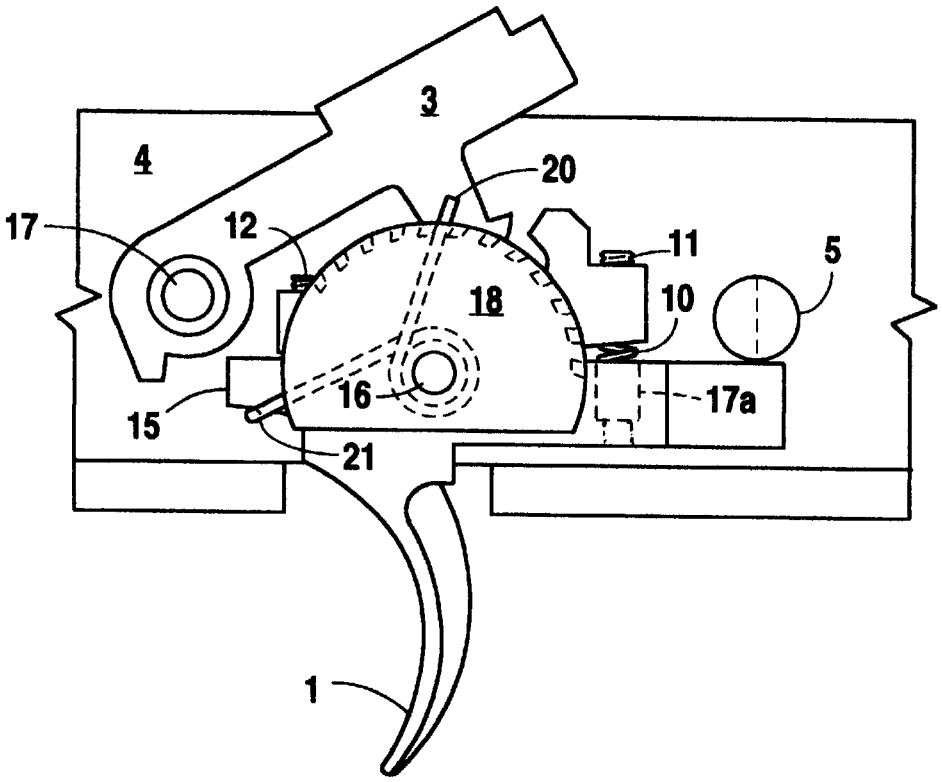
FIG. 3 shows details of the adjustable torsion spring loaded trigger mechanism.
Figure 4:
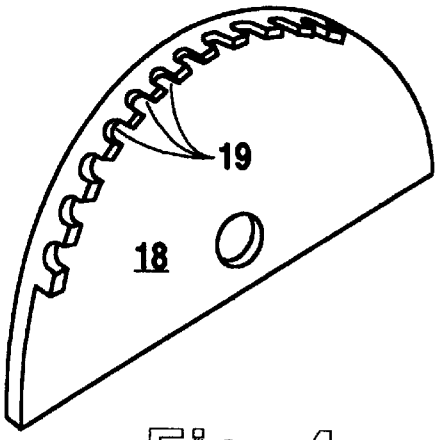
FIG. 4 shows a three dimensional view of the trigger spring adjustment plate.
Figure 5:
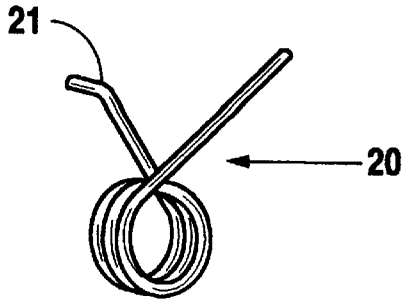
FIG. 5 shows a view of the trigger spring.

In FIG. 2 all components are is previously discussed with the pull pressure on trigger 1 overcoming the resistance on the trigger torsion spring 20 shown and discussed under FIGS. 3, 4, and 5 end with trigger 1 being partially depressed to the point where the face or contact point 8 of disconnect lever catch 13 contacts hammer tang 9 and trigger sear 6 is minimally engaged with hammer notch 7. At this point the first stage pull is complete and the user may adjust screw 11 with the trigger assembly installed in the gun to adjust the trigger pull pressure needed to compress spring 10 sufficiently to allow the weight of the pull desired to disengage trigger sear 6 and hammer notch 7 to allow the assembly to fire. This is the second stage of the trigger pull and as outlined the user may adjust travel in the second stage and trigger pull pressure needed in the second stage. Total travel is the first stage travel plus the second stage travel therefor adjusting second stage travel also adjusts the first stage travel. Necessarily safety cam 5 is in the fire position.

At the instant the trigger second stage pull is complete and while the trigger 1 is still held in the pulled position the recoil position of hammer 3 causes hammer tang 9 to force disconnect lever catch 13 downward to compress spring 10 and to trap the hammer 3 it its tang 9. Release of the pulled trigger 1 causes the trigger torsion spring 20, FIG. 3 to return the trigger to the unpulled or reset position. As trigger 1 moves toward the reset position the disconnect lever 2 operably connected therewith begins to release hammer tang 9 from the engagement with the disconnect lever catch 13 and hammer notch 7 fully engages trigger sear 6 with total separation of hammer tang 9 and disconnect lever catch 13 to complete the firing and reset cycle.

In FIG. 3 trigger torsion spring 20 is installed on pin 16 in cavity 4 and is operably connecting the trigger 1 and torsion spring adjustment plate 18 with a bent first end 21 on spring 20 extending under a forward end 15 of trigger 1 and a second end of spring 20 movably engaging notches 19, FIG. 4 on plate 18. Torsion urging trigger 1 forward and increasing pressure to depress trigger 1 is user adjustable by moving the second end of spring 20 in notches 19. This movement may be made without disturbing the assembly. A cavity 17*a* receives compressible spring 10, FIG. 1 to adjust second stage trigger pull pressure as described under FIG. 1

FIG. 4 shows a three dimensional view of torsion spring adjustment plate 18 to indicate notches 19 on a side of plate 18 to adjust torsion on spring 20, FIG. 3.

FIG. 5 shows the trigger torsion spring 20 which adjusts first stage trigger pull pressure with the coil of spring 20 sized to fit over pin 16 FIG. 3 and with bent end 21 to fit under trigger 1, FIG. 3 so that increasing torsion on spring 20 increases first stage pull pressure of trigger 1 and also acts to return trigger to the firing position after the gun is fired and the trigger is released.

What is claimed is:

1. An adjustable dual stage trigger assembly comprising:

a spring activated hammer, a disconnect lever, and a torsion adjustable spring loaded trigger means;

said spring activated hammer being pivotally connectable with a first pin through a receiver cavity of a firearm and having a hammer notch and a hammer tang;

said spring loaded trigger means being pivotally connectable with a second pin through said receiver cavity and having a trigger sear engaging said hammer notch when the firearm is in a cocked position;

said disconnect lever being pivotally connectable with said second pin and being operably connected with said trigger means;

a first threaded adjustment means adjustable by a user of said firearm in said disconnect lever on a first end of said disconnect lever and a second threaded adjustment means adjustable by said user on a second end of said disconnect lever, said first and second threaded adjustment means being adjustable without disturbing said assembly;

said first threaded adjustment means allowing said user to adjust engagement of said trigger sear with said hammer notch to a user desired engagement and causing a contact portion of said disconnect lever to contact said hammer tang on said hammer;

said second threaded adjustment means acting to compress a spring against said trigger to adjust pressure of said contact portion of said disconnect lever against said hammer tang thereby adjusting trigger pressure needed to fire said firearm after said contact portion of the said disconnect lever contacts said hammer tang.

2. An adjustable dual stage trigger assembly as in claim 1 wherein said adjustable spring loaded trigger means comprises a semicircular plate with a notched semicircular edge on a side of said plate and an opening to fit over said second pin and sized to fit immovably in said receiver cavity of said firearm; a torsion spring operably connected to said semicircular plate with a first terminal end operably connecting with said trigger and a second terminal end capable of being selectively placed by said user in one of a plurality of notches in said plate thereby allowing said user, without disturbing said assembly, to move said second terminal end to adjust pressure to urge said trigger toward a forward position as pressure from the torsion spring is adjusted by moving and placing the second terminal end in said notches.

3. An adjustable dual stage trigger assembly comprising:

a spring activated hammer, a disconnect lever, and a tension adjustable spring loaded trigger;

said spring activated hammer being pivotally connectable with a first pin through a receiver cavity of a firearm and having a hammer notch and a hammer tang;

said tension adjustable spring loaded trigger being pivotally connectable with a second pin through said receiver cavity and having a trigger sear fully engaging said hammer notch when said firearm is in a cocked position;

said disconnect lever also being pivotally connectable with said second pin and being operably connected with said tension adjustable spring loaded trigger;

a first threaded adjustment means, adjustable by a user of said firearm, in said disconnect lever on one end of said disconnect lever and a second threaded adjustment means, adjustable by said user, or an opposite end of said disconnect lever; said first threaded adjustment means allowing said user to adjust lengths of contact faces of said sear and said hammer notch to have desired engagement of said sear and said hammer notch; said spring loaded trigger, said hammer tang, and said disconnect lever being so shaped and sized that a contact portion of said disconnect lever contacts said hammer tang on said hammer simultaneously with said user adjustment to have said desired engagement of said sear and said hammer notch; and said second threaded adjustment means acting to compress a spring against said trigger thereby adjusting trigger pressure needed to fire said firearm after said contact portion of said disconnect lever contacts said hammer tang.

4. An adjustable dual stage trigger assembly in a firearm comprising a spring loaded hammer means, a disconnect lever means, a user adjustable spring loaded trigger means, and an engagement means to engage said hammer means with said trigger means when said firearm is in a cocked position;

said disconnect lever means being operably connected with said trigger means and having a first user adjustable screw to adjust said engagement means to a user desired engagement without disturbing said assembly and causing contact between a tang on said hammer means and a contact end on said disconnect lever means;

said disconnect lever means further having a second user adjustable screw to compress a spring to adjust pressure of said contact end against said tang and cause an additional resistance to a pull on said spring loaded trigger means, said additional resistance being in addition to an adjustable spring loading on said adjustable spring loaded trigger means;

a first stage movement of said dual stage trigger assembly ends when said contact end of said disconnect lever means contacts said hammer tang;

a second stage movement of said trigger assembly to cause the firearm to fire, ends with additional pull to overcome said additional resistance and disengage said engagement means.

* * * * *